United States Patent [19]

Hutzenlaub

[11] 4,140,287

[45] Feb. 20, 1979

[54] SIMULTANEOUSLY RELEASABLE SHAFT-MOUNTED REELS

[76] Inventor: Armin S. P. Hutzenlaub, Am Stichelburg 24, 5276 Wiehl-1, Fed. Rep. of Germany

[21] Appl. No.: 857,014

[22] Filed: Dec. 2, 1977

[30] Foreign Application Priority Data

Dec. 17, 1976 [DE] Fed. Rep. of Germany ..... 2657203

[51] Int. Cl.[2] ..... B65H 19/04

[52] U.S. Cl. ..... 242/56.9; 242/68.3; 242/72.1

[58] Field of Search ..... 242/56.9, 68.3, 68, 242/72.1

[56] References Cited

U.S. PATENT DOCUMENTS

| | | | |
|---|---|---|---|
| 2,709,051 | 5/1955 | Bunch | 242/68.3 |
| 2,833,488 | 5/1958 | Kerber | 242/56.9 |
| 3,322,365 | 5/1967 | Martin | 242/68.3 |
| 3,554,457 | 1/1971 | Hutzenlaub | 242/56.9 |
| 3,921,926 | 11/1975 | Jores | 242/56.9 |

*Primary Examiner*—Edward J. McCarthy
*Attorney, Agent, or Firm*—Bacon & Thomas

[57] ABSTRACT

A shaft releasably supports a plurality of separately rotatable winding reels held in place by clamps. Each reel is mounted on a sleeve assembly including an axially slidable portion, spring biased in one direction, normally holding the clamps engaged with the reels. When one of the portions is forcibly moved axially to release its clamp, it engages and moves the slidable portion of the next adjacent sleeve assembly so that all reels may be released simultaneously.

7 Claims, 5 Drawing Figures

SIMULTANEOUSLY RELEASABLE SHAFT-MOUNTED REELS

The invention relates to a winding shaft with supporting rings for winding reels, each supporting ring comprising a sleeve, movable in the axial direction against the force of a readjusting spring, and movable clamping elements, projecting in the radial direction from the circumferences of the supporting rings, and operated by a conical surface of the sleeve.

Such a winding shaft has a plurality of supporting rings, for example, up to twenty, and more, supporting rings which are rotatable without contacting one another. Equipping such a winding shaft is very labor-expensive due to the fact that each individual winding reel must be clamped upon its associated supporting ring. In case of sensitive winding material each individual winding reel must be precisely aligned and tightened on the associated supporting ring.

The principal of the invention is the provision of a winding shaft of the above-mentioned type wherein a simple releasing of clamping elements permits removal of the winding reels and correspondingly a quick and safe clamping is possible after the placing of empty winding reels on the shaft. This being possible while maintaining the supporting rings free of contact with each other.

According to the invention this object is achieved by the common releasing and clamping of a plurality of supporting rings, placed upon the winding shaft and being individually drivable and being rotatable out of contact with one another. There are provided double-acting setting elements and a coupling device for the transmission of a common axial motion to all sleeves, the release position of the clamping elements corresponding to one end position of the setting element and the clamping position of the clamping elements corresponding to the other end position of the setting element.

By the displacing of the sleeves in the axial direction, there results a safe and simultaneous releasing of all clamping elements so that it is possible to remove the associated winding reel without difficulty. After replacing with an empty winding reel, one allows the sleeve, under the action of a readjusting spring, to return to its initial position; thereby the clamping elements are automatically set. The supporting rings remain completely separated from one another in the axial direction and do not influence one another by rolling friction or by sliding friction. The clamping elements of the different supporting rings are independent from one another so that tolerances of the winding sleeves will be compensated.

In order to ensure that the clamping elements are clamped in a safe manner, the invention provides that there is arranged in a circumferential slot of the supporting ring a helical spring which also engages slots of the clamping elements. Thus, this helical spring pulls the clamping elements in a radially inward direction so that the clamping elements are safely clamped against the force of the readjusting spring when displacing the sleeve.

The winding shaft according to the invention provides, as a further feature, that the sleeves themselves are effective as coupling devices. By the moving of an end sleeve all further sleeves are displaced and, consequently, are brought into the release position for their clamping elements.

According to a modified embodiment of the invention the arrangement may be made in such a manner that each sleeve comprises a U-ring open toward the axis of the winding shaft, and the coupling device comprises drawbars, guided in the axial direction of the winding shaft and engaging the U-rings by means of engaging projections. Thereby it is possible to simultaneously operate the sleeves of all supporting rings of a winding shaft by means of the said drawbars. This requires, for the drawbars, a relatively short adjusting distance.

For the operation and displacement of the sleeves the invention provides a slide, or a pull ring which is slidably mounted on a shield-plate, supporting the winding shaft.

Embodiments of the invention will be described in the following with reference to the attached drawings, wherein FIG. 1 is a partial sectional view of a winding shaft according to the invention;

Figure 1:
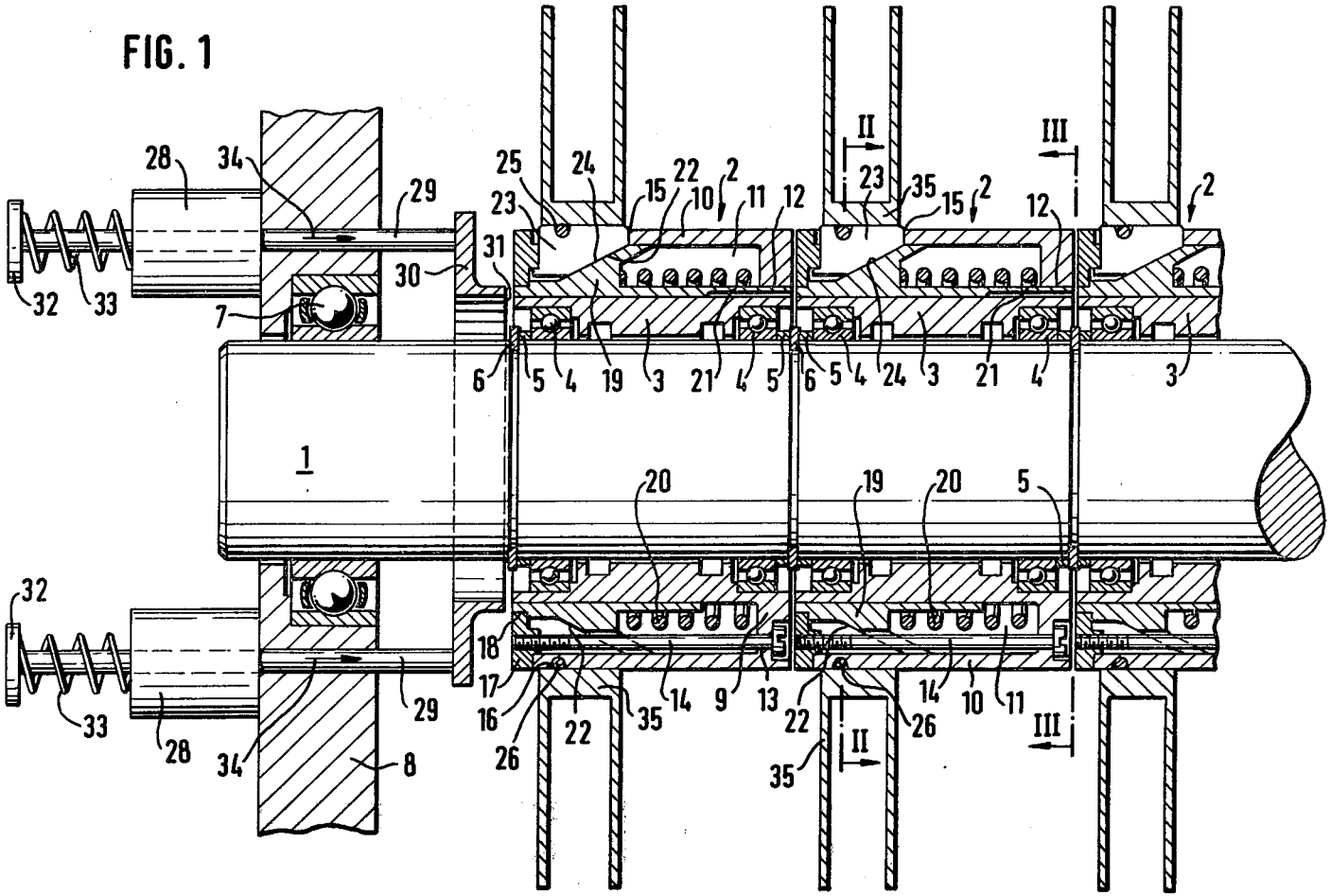
Figure 2:
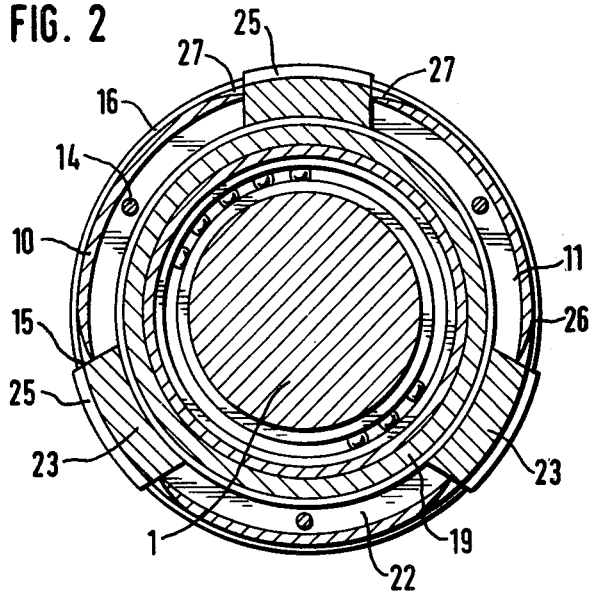
FIG. 2 is a sectional view taken along the line II—II in FIG. 1.
Figure 3:
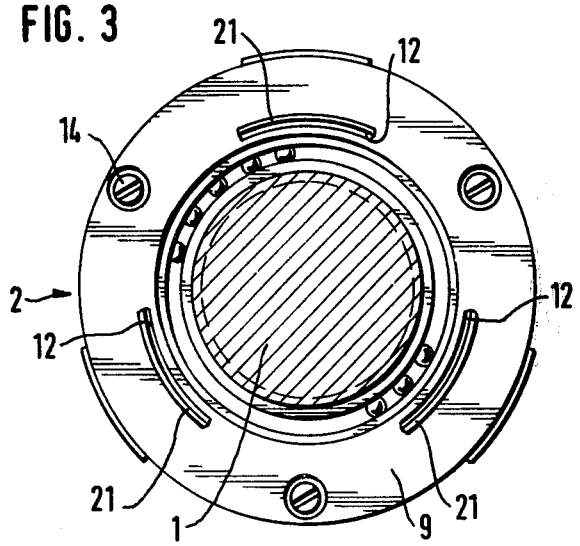
FIG. 3 is a sectional view taken along the line II—III in FIG. 1.

A winding shaft 1 has thereon a plurality of supporting rings 2, the ring housings 3 being supported on ball bearings 4. By spacer rings 5 and Seeger circlip rings 6 axial retention of the supporting rings 2 is effected. Within the winding shaft 1 friction elements for the supporting rings 2 are provided (not shown) in a known manner which (friction elements) are not shown. The winding shaft 1 is mounted in ball bearings 7 at the ends and is driven by drive devices, not shown. The bearing 7 is located within a shield-plate 8.

Each ring housing 3 comprises a front ring 9 and a radially spaced outer casing 10 so that there is an annular hollow space 11 between the ring and housing. The front ring 9 comprises a plurality, perhaps three segment-shaped recesses 12 and passages 13 for clamp screws 14. Furthermore, there are provided in the outer casing 10 a plurality of slots, e.g. three slots 15. On a circumferential arc extending through the slots 15 there is provided a circumferential groove 16. The end of the ring housing 3 opposite the front ring 9 is terminated by a ring plate 17 which is held in place by the clamp screws 14. The ring plate 17 defines a circumferential slot 18 between its inner edge and the inner part of the ring housing 3.

In the annular hollow space of the ring housing 3 there is rranged an axially slidable sleeve 19 which is urged in one direction by a compression spring 20. The sleeve 19 comprises three segment-shaped tongues 21 which extend into the recesses 12 of the ring 9. The other end of sleeve 19 occupies the circumferential slot 18. On the sleeve 19 there is provided a conical ring face 22 inwardly of the slots 15. Within the slots 15 there are arranged segment-shaped clamping elements 23 each having a sliding surface 24 complementary to the conical face 22. In addition, there is provided in the outer surface of each of the clamping elements 23 extending in the circumferential direction, a slot 25. In the circumferential groove 16 of the outer casing 10 as well as in the slots 25 a helical spring 26 is placed which keeps the clamping elements 23 biased radially inward. The circumferential groove 16 has portions 27, each sloping into the slots 15.

The shield-plate 8 may be a shield-plate of the winding machine. However, the shield-plate 8 may also belong to a separate equipping device and may have the ball bearings 7 for the winding shaft 1. The shield-plate 8 comprises setting elements 28, e.g., hydraulic units for moving rods 29 in the direction of arrow 34 and which rods carry an annular or ring-shaped slide 30, the front edge 31 of which is directed to the rotating front face of slidable sleeve 19 of the adjacent supporting ring 2. The slide rods terminate in contact plates 32, against which compression springs 33 react and which urge the slide 30 in a direction opposite the arrow direction 34. The slide 30, thus, is normally kept at a distance from the front edge of sleeve 19 by the action of the compression springs 32.

The supporting rings 2 each support a winding reel 35, e.g., a flanged reel which is clamped by the clamping elements 23. After termination of the winding operation the winding shaft 1 enters the equipping station or a special equipping device and is received there within the shield-plate 8. The winding shaft 1 remains self-supporting at the other end in order to be able to remove and add the reels later on. The setting elements 28 are the actuated to displace slide 30 in the direction of arrow 34. The front edge 31 then presses against the edge of sleeve 19 so that the same is axially displaced to the right, as seen in FIG. 1. The tongues 21 of each sleeve 19 thereby engage the front edge of the adjacent sleeve 19 so that all sleeves 19 are uniformly moved to the right. Also, the conical faces 22 are displaced to a corresponding extent so that the clamping elements 23 can slide radially inwardly along the inclined surfaces 24. Tehreupon, the helical spring 26 draws the clamping elements 23 inwardly. The portions 27 enable full effectiveness of the helical spring 26. As soon as all clamping elements are released, it is possible to freely withdraw the winding reels 35 axially. The winding shaft 1 may then be supplied with empty winding reels. The supplying may be carried out by a push-up auxiliary device and positioning device so that all winding reels 35 may be positioned automatically. After the positioning of the winding reels 35 the setting elements 28 are released so that the compression springs 33 pull the slide 30 back. The sleeves 19 are then moved back by the helical springs 20 so that the conical faces 22 force the clamping elements 23 radially outwardly and, thus, hold the winding reels 35 in a secure manner.

Figure 4:
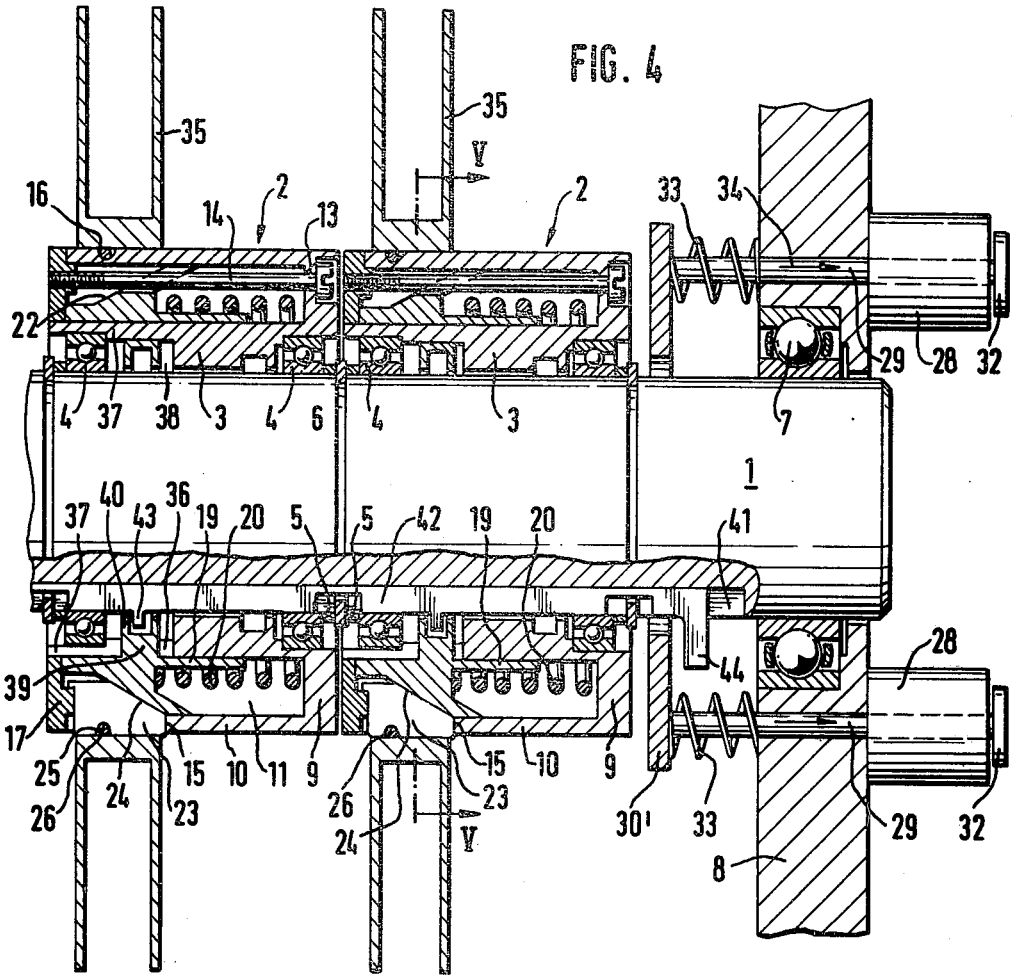
FIG. 4 is a section through a further embodiment of a winding shaft according to the invention.
Figure 5:
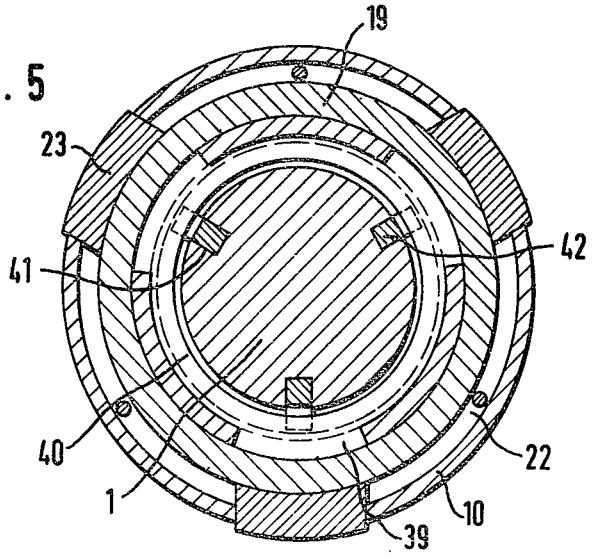
FIG. 5 is a sectional view taken along the line V—V in FIG. 4.

A modified embodiment of the invention is shown in FIGS. 4 and 5. The inner casing of ring housing 3 has, inwardly of the slots 15 and at the end near plate 17, open slots 36 between ring portions 37 which are supported on the adjacent ball bearing 4. The ring portions 37 have a recess or gap 38 facing the winding shaft 1. From the sleeve 19 members 39 extend through the slots 36 radially inwardly and which carry a U-shaped ring 40 which is situated within the gap 38.

The periphery of winding shaft 1 has a number of axial grooves 41, in each of which a drawbar 42 is axially slidable. The drawbars 42 have engaging projections 43 extending into the open profiles of the U-rings 40. There is a draw-hook 44 at the end of each draw-bar 42. Within the shield-plate 8 there are guided setting rods which are operable by setting elements 28 and carry a slide in the form of a draw-ring 30'. FIG. 4 shows the draw-ring 30' in the inactive condition, where the drawbars 42 are not loaded. The compression springs 20 press the sleeves 19 against the ring plates 13. The clamping elements 23 are pressed radially outwardly and clamp the winding reels 35.

For the equipping of the winding shaft 1 with empty reels, the setting elements 28 are actuated to displace the draw-ring 30' to the right, as seen in FIG. 4. Correspondingly, the drawbars 42 are drawn to the right and engage the U-rings 40 by their engaging projections 43 so that the sleeves 19 are displaced against their springs 20. The clamping elements 23 then are drawn radially inwardly by the compression spring 26. Consequently, the winding sleeves 35 are freely removable. Then an equipping and a clamping of the empty winding reels may be carried out by the releasing of the setting elements 28.

I claim:

1. A shaft for releasably supporting a plurality of reels axially spaced therealong, comprising:

a plurality of separately rotatable reel supports rotatably mounted on said shaft, each including an axially slidable sleeve urged in one direction by resilient means;

each reel support including radially slidable clamp elements having first cam surfaces inclined to said shaft;

each sleeve having second inclined cam surfaces engaging said first cam surfaces to move said clamp elements outwardly when said sleeves are spring-urged in said one direction;

means for simultaneously axially moving each sleeve against the urging of its spring; and setting means for actuating said last-named means to thereby simultaneously release all said clamp elements.

2. A shaft as defined in claim 1 wherein said resilient means comprises a helical spring having a portion in a circumferential slot in said reel support and said clamping elements.

3. A shaft as defined in claim 2 wherein each of said sleeves has one end in the form of an edge surface and the other end has tongues extending axially therefrom whereby axial movement of one sleeve causes its tongues to engage the edge surface of an adjacent sleeve to move the same axially.

4. A shaft as defined in claim 3 including a shield plate supporting one end of said shaft, said setting means being mounted on said shield plate for movement axially of said shaft and including a member engageable with said edge surface of an end sleeve on said shaft to thereby move said sleeve axially.

5. A shaft as defined in claim 2 wherein each of said sleeves is provided with means defining an inwardly facing circumferential channel, and a drawbar slidable along said shaft and having projections extending outwardly therefrom into said channels.

6. A shaft as defined in claim 5 wherein said shaft is provided with circumferentially spaced longitudinal grooves, there being a drawbar in each groove.

7. A shaft as defined in claim 6 wherein an end of each drawbar terminates in a hook-like element;

said setting means comprising a draw ring engageable with said hook-like elements; and means mounting said draw rings for movement axially of said shaft.

* * * * *